US005794395A

United States Patent [19]

Reed

[11] Patent Number: 5,794,395

[45] Date of Patent: Aug. 18, 1998

[54] ANCHOR BRACKET WITH CLEATS

[76] Inventor: Robert H. Reed, 25557 Snyder, Conifer, Colo. 80433

[21] Appl. No.: 666,761

[22] Filed: Jun. 19, 1996

[51] Int. Cl.[6] ..... E06B 1/02; F16B 7/08

[52] U.S. Cl. ..... 52/298; 52/712; 403/230; 403/282

[58] Field of Search ..... 52/242, 287.1, 52/288.1, 296, 297, 298, 712, 714; 248/300; 403/199, 230, 262, 282, 403; 428/157, 177, 573, 574, 595, 603, 604

[56] References Cited

U.S. PATENT DOCUMENTS

| | | | |
|---|---|---|---|
| 2,667,317 | 1/1954 | Trebules | 52/298 |
| 4,330,971 | 5/1982 | Auberger . | |
| 4,381,160 | 4/1983 | Grimm et al. . | |
| 4,430,833 | 2/1984 | Balzer et al. | 52/255 |
| 5,060,435 | 10/1991 | Bogdanow . | |
| 5,143,472 | 9/1992 | Reed et al. . | |
| 5,217,317 | 6/1993 | Young . | |
| 5,297,892 | 3/1994 | Preziosa . | |
| 5,364,203 | 11/1994 | Ishikawa | 403/403 |
| 5,438,811 | 8/1995 | Goya . | |
| 5,457,928 | 10/1995 | Sahnazarian | 403/403 X |

*Primary Examiner*—Carl D. Friedman
*Assistant Examiner*—Timothy B. Kang
*Attorney, Agent, or Firm*—John E. Reilly

[57] ABSTRACT

An anchor bracket assembly is made up of a plurality of anchor brackets for securing a support post or newel to a floor surface, each anchor bracket having an upright attachment portion affixed to the post and a substantially horizontal flange portion extending outwardly from the lower end of the attachment portion with projections extending downwardly from a free end of the flange portion and which bear against the floor surface so that when fasteners are inserted through openings in the flange portion between the projections and attachment portion and drawn tightly into the floor surface will cause the flange portion and attachment portion to move downwardly about the projections thereby drawing the post more firmly against the floor surface.

14 Claims, 1 Drawing Sheet

ANCHOR BRACKET WITH CLEATS

BACKGROUND AND FIELD OF INVENTION

This invention relates generally to devices for securing one support member to a second support member in a selected orientation and more particularly, relates to an improved bracket for anchoring a post or newel in upstanding relation to a floor or other support surface, the improved bracket having a plurality of cleats or ribs which draw the post more firmly against the floor, thus providing a more rigid anchor.

A variety of devices have been developed to firmly secure a post or newel in an upright position relative to a floor or other support surface, particularly useful when building hand railings which necessarily require firm anchoring to support a person leaning on it for support while ascending or descending stairs. For example, in U.S. Pat. No. 5,143,472 there is disclosed a J-shaped anchor bracket having an obtuse, angular flange extending away from the post with pig-tailed fasteners extending through the angular flanges into the floor, and molding or cover strips positioned over the anchor brackets. Young, in U.S. Pat. No. 5,217,317, shows a bracket for connecting a rafter to a beam at a variety of sloped and skewed angles which includes a raised spherical portion and an offset nail-receiving opening to facilitate angled nailing of the bracket to the beam or rafter. U.S. Pat. No. 4,330,971 to Auberger shows a U-shaped bracket that is connected directly to a floor by flanges that flare outwardly from the bracket's bottom edge. U.S. Pat. Nos. 5,297,892, 5,060,435, and 5,438,811 to Preziosa, Bogdanow and Goya, respectively, are of general interest as representative of the state of the art.

The present invention is a decided improvement over the above and other such devices, in that it provides a means for more rigidly anchoring a post to a floor surface in the form of cleats or ribs extending downwardly from the bracket. When the bracket is secured to the post, the cleats or ribs are depressed slightly into the floor and act as a fulcrum to more firmly draw the post towards the floor. The cleats or ribs, used in combination with standard fasteners, provide a more effective means for securing an upright post against a floor, and unlike other brackets, can also be used to repair or strengthen existing support posts, rather than only in a new installation of a support post.

SUMMARY OF THE INVENTION

It is therefore an object of the present invention to provide an improved and novel anchor bracket and assembly for rigidly securing the base of a post to a floor surface.

It is another object of the present invention to have one or more elements which act as a fulcrum to draw the post more firmly towards the floor surface when the bracket is installed.

It is a further object of the present invention to provide an anchor bracket with cleats or teeth which depress slightly into the floor surface, thus more firmly anchoring the post to the floor.

In accordance with the present invention, an anchor bracket has been developed for securing a post in an upright position relative to a support surface or floor, wherein one end of the post is in direct contact with the floor. The bracket broadly comprises a flange portion extending at a right angle from an upper attachment portion. The flange has at least one downwardly extending projection, such as, one or more cleats or ribs at a free end of the flange spaced from the post.

When properly installed, the upper attachment portion is secured with fasteners to a vertical wall of the post and the flange portion is secured to the floor surface so that the flange portion extends at slightly less than a right angle from the post. When thus secured, the cleats or ribs bear against the floor surface, and the fasteners are inserted between the cleats and the post to cause the flange inwardly of the cleats to move downwardly about the cleats thereby drawing the post more firmly toward the floor and creating a more rigid and stable anchor between the post and the floor. Each of the flange and attachment portions includes a plurality of openings through which the fasteners, such as wood screws, are secured at right angles to the floor and post, respectively.

The above and other objects and features of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 3:
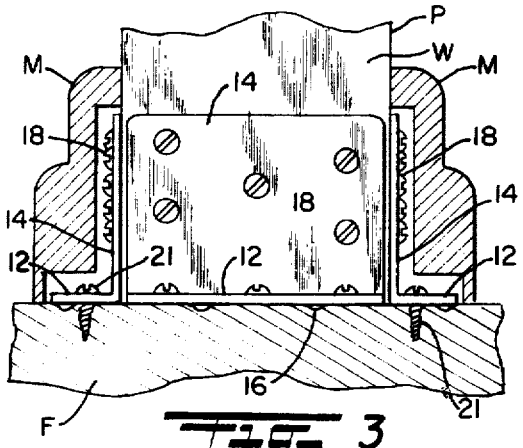
FIG. 3 is a side view of the anchor bracket with cleats secured to the post and into the floor and covered with decorative molding.
Figure 4:
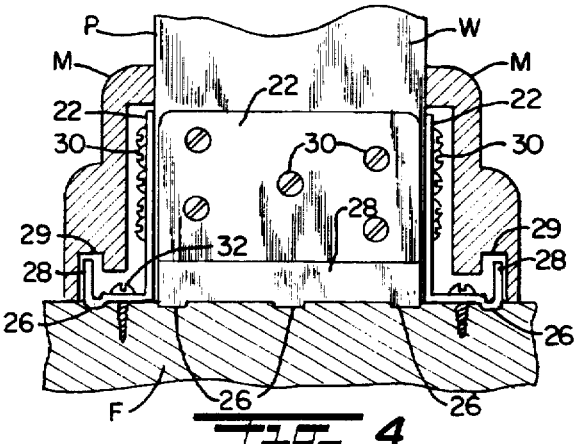
FIG. 4 is a side view of the anchor bracket with teeth secured to the post and floor and covered with decorative molding.

Referring now in more detail to the drawings, FIGS. 1 through 6 illustrate two forms of the anchor bracket of the present invention, 10, 20, which is contemplated specifically for use in securing a wood post or newel P in upstanding relation to a wood floor surface F. As shown in the drawings, it is preferable that a plurality of brackets 10, 20 be used when it is desired to firmly anchor a post P to a floor, such as, in the case of a hand rail or other railing. The bracket 10 is secured to the lower end of the post P, the lower end of which is in direct contact with the floor F, and also to the floor F in the manner to be described, and as shown in FIGS. 3 and 4, may also be used with overlying decorative molding configured to cover the bracket and create a more attractive appearance.

Figure 5:
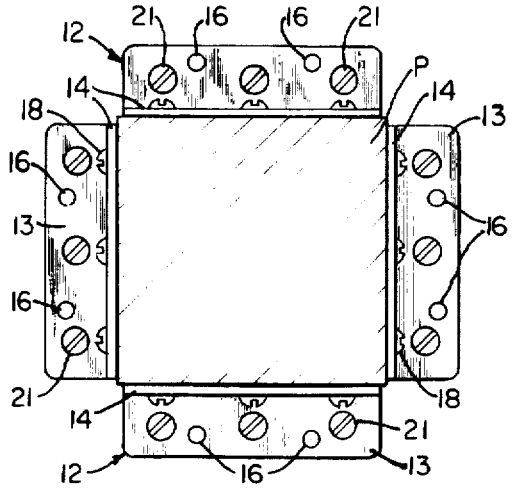
FIG. 5 is a top view of the anchor bracket with cleats secured to the post and floor.
Figure 1:
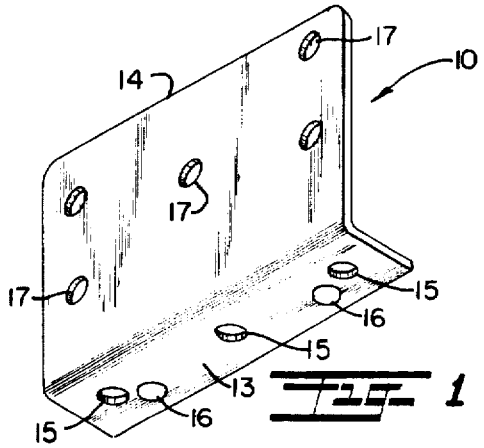
FIG. 1 is a perspective view of the anchor bracket of the present invention illustrating a plurality of cleats extending from the lower surface of the flange portion.
Figure 2:
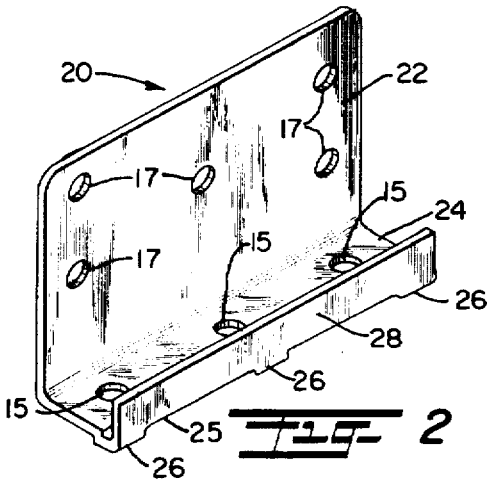
FIG. 2 is a perspective view of the second embodiment of the anchor bracket of the present invention illustrating downwardly projecting ribs on the flange portion.

Turning first to FIGS. 1, 3 and 5, the form of the anchor bracket 10 generally comprises a flange portion 12 and an attachment portion 14 extending upwardly at a right angle from the flange portion 12. Each flange portion 12 and attachment portion 14 includes a plurality of openings 15, 17 arranged in spaced intervals across each respective portion through which fasteners are received and secured into the floor F and the post P, respectively, in the manner to be described. The flange portion 12 has at least one projection, shown in FIGS. 1, 3 and 5, as rounded cleats 16 in the flange's upper surface 13 stamped and extending downwardly from the lower surface of the flange 12 into the floor F.

As best seen from FIGS. 3 and 5, the upper attachment portion 14 is secured to a vertical wall W of the post P via fasteners, such as, wood screws 18 extending through the openings and into the post at right angles, such that the attachment portion 14 is in flush relation to a vertical wall of the post P; and the flange portion 12 extends at a right angle from the post P and is spaced slightly above the floor F by the cleats 16. Fasteners, such as, wood screws 21 are secured into the floor F through the flange openings between the cleats 16 and post P so that the flange 12 and post P are drawn downwardly about the cleats 16 which act as fulcrum points but also are depressed slightly into the wood floor F.

When the anchor bracket 10 is secured to the post P and floor F in this manner, the rounded cleats 16 depress slightly into the floor F, thereby drawing the post P more firmly toward the floor F, thus creating a more rigid anchor between the post P and floor F.

As FIG. 3 illustrates, molding M, cut to conform to the shape of the anchor bracket 10, can be fitted over anchor bracket 10 and secured to the post P and floor F by wood glue or other means, such as, nails or screws.

Figure 6:
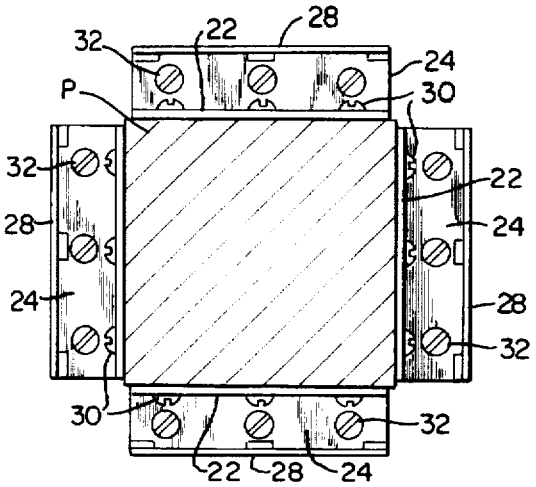
FIG. 6 is a top view of the anchor bracket with ribs secured to the post and floor.

In another form of the present invention, the anchor bracket 20 still comprises an upper attachment portion 22 and a flange portion 24, which extends at a right angle from the attachment portion 22. In this form, however, the outer, longitudinal edge 25 of the flange 22 has a plurality of downwardly projecting ribs or teeth 26, which serve the same function as the rounded cleats described above. When the anchor bracket 20 is secured to the post P and floor F as shown in FIGS. 4 and 6, the downwardly projecting ribs 26 will bear against the floor F, thereby drawing the post P firmly toward the floor F. Again, it is contemplated that the attachment portion 22 and flange portion 24 are secured to the post P and floor F via fasteners, such as, wood screws 30, 32, respectively, such that the upper attachment portion 22 is in flush, vertical relation to a wall of the post P and the lower surface of the flange portion 24 extends at a right angle away from the post P and is drawn downwardly against the floor F with the ribs 26 acting as a fulcrum. A lip 28 extends upwardly from the outer edge of the flange 24 for insertion into a groove 29 in the molding M.

In both forms of the present invention, the anchor bracket 10, 20 is preferably formed by stamping out of metal so that the bracket 10, 20 is of one-piece construction. The cleats 16 are stamped out through the upper surface of the flange 12 to extend slightly from the lower surface of the flange 12 to depress slightly into the floor F when the bracket 10 is installed. While the drawings illustrate the anchor bracket 10, 20 being of a generally rectangular configuration for use with a post having a generally rectangular cross-section, the anchor bracket 10, 20 may also be configured to conform to various shapes of posts P having different curvatures or surface configurations of side walls. Likewise, the drawings show the attachment portion 14, 22 having a width substantially conforming to the width of the walls W of the post, although the brackets may be reduced in width to conform to a reduced width in the post P. Fasteners other than wood screws may be employed when the post or floor is constructed of material other than wood, which was used as an example herein. In addition, the flanges 24 may include upwardly directed lips at their outer or free ends to aid in aligning the molding strips over the brackets 10.

It is therefore to be understood that while preferred forms of the invention are herein set forth and disclosed, various modifications and changes may be made therein without departing from the spirit and scope of the present invention as defined by the appended claims and reasonable equivalents thereof.

I claim:

1. An anchor bracket for securing a post in an upright position relative to a support surface wherein one end of said post is in direct contact with said support surface, said bracket comprising:

a flange portion adapted for extending at a right angle from said post with a lower surface of said flange adapted to exend in substantially parallel relation to said support surface;

at least one projection extending downwardly from said lower surface of said flange and adapted to bear against said support surface when said bracket is secured to said post thereby drawing said post toward said support surface and wherein each said projection is in the form of a rounded cleat; and an attachment portion extending upwardly at a right angle from said flange portion, said attachment portion adapted to be disposed in flush relation to a vertical wall of said post.

2. A bracket according to claim 1 wherein said attachment portion includes at least one opening therethrough, and first securing means for extension through said opening into said vertical wall of said post for securing said attachment portion to said post.

3. A bracket according to claim 2 wherein said first securing means is defined by wood screws.

4. A bracket according to claim 1 wherein said flange portion includes at least one opening therethrough between said projection(s) and said attachment portion, and second securing means adapted to extend through said openings into said support surface for securing said flange portion to said support surface.

5. A bracket according to claim 4 wherein said second securing means is defined by wood screws.

6. A bracket according to claim 1 wherein each said projection is defined by a series of spaced, rounded cleats in said flange portion.

7. A bracket according to claim 1 wherein each said projection is defined by ribs extending downwardly from a longitudinal edge of said flange portion spaced from said attachment portion.

8. In an anchor bracket and post assembly for securing the post in an upright position relative to a support surface, the combination comprising:

at least one bracket, each said bracket having a flange portion extending substantially at a right angle away from said post parallel to said support surface, at least one projection extending outwardly and downwardly from a lower surface of said flange portion and bearing against said support surface and wherein an edge of said flange portion terminates in an upwardly directed lip, an attachment portion extending substantially upwardly at a right angle from said flange portion; and first securing means for securing said attachment portion to a vertical wall of said post, and second securing means for securing said flange portion to said support surface.

9. In an assembly according to claim 8 further comprising a molding portion having a groove into which said lip is received.

10. In an assembly according to claim 8 wherein said projection is defined by a rounded cleat protruding downwardly from said flange.

11. In an assembly according to claim 8 wherein said projection is defined by a rib projecting downwardly from a longitudinal edge of said flange.

12. In an anchor bracket and post assembly for securing the post in upstanding relation to a floor surface having an upright attachment portion and horizontal flange portion, the combination therewith comprising:

at least one projection extending downwardly from said flange portion and bearing against said floor surface, said flange portion disposed in parallel to said floor surface and extending at a right angle from said attachment portion, said attachment portion disposed in flush relation to a vertical wall of said post, and securing means in the form of screws extending through openings in said flange portion between said attachment portion and said at least one projection for extension into said floor surface wherein tightening of said screws draws said flange portion, said post and said attachment portion downwardly with respect to said at least one projection.

13. In a bracket according to claim 12 wherein said projection is defined by rounded cleats in said flange portion.

14. In a bracket according to claim 12 wherein said projection is defined by ribs extending downwardly from a longitudinal edge of said flange portion.

* * * * *